US006155090A

United States Patent [19]

Rubensson

[11] Patent Number: 6,155,090

[45] Date of Patent: Dec. 5, 2000

[54] CYLINDER LOCK

[75] Inventor: Björn Rubensson, Eskilstuna, Sweden

[73] Assignee: ASSA AB, Eskilstuna, Sweden

[21] Appl. No.: 09/284,868

[22] PCT Filed: Oct. 30, 1997

[86] PCT No.: PCT/SE97/01820

§ 371 Date: Apr. 22, 1999

§ 102(e) Date: Apr. 22, 1999

[87] PCT Pub. No.: WO98/19031

PCT Pub. Date: May 7, 1998

[30] Foreign Application Priority Data

Oct. 31, 1996 [SE] Sweden ..... 9603981

[51] Int. Cl.[7] ..... E05B 27/00

[52] U.S. Cl. ..... 70/367; 70/455; 70/375; 70/424; 70/417

[58] Field of Search ..... 70/358, 375, 367–372, 70/453–455, 427, 417, 416, 423, 424

[56] References Cited

U.S. PATENT DOCUMENTS

| | | | |
|---|---|---|---|
| 1,411,898 | 4/1922 | Augenbraun . | |
| 1,422,517 | 7/1922 | Augenbraun | 70/417 |
| 1,422,594 | 7/1922 | Maxwell | 70/417 |
| 1,568,462 | 1/1926 | Moritz et al. | 70/455 X |
| 1,575,092 | 3/1926 | Best | 70/455 X |
| 3,736,780 | 6/1973 | Singer | 70/453 |
| 4,478,061 | 10/1984 | Preddey | 70/358 |
| 5,383,344 | 1/1995 | Zambell | 70/209 |
| 5,507,163 | 4/1996 | Juang | 70/369 |
| 5,737,948 | 4/1998 | Lefkovits | 70/455 X |
| 6,079,240 | 6/2000 | Shvarts | 70/367 |

FOREIGN PATENT DOCUMENTS 8403605-2 3/1985 Sweden .

*Primary Examiner*—Suzanne Dino Barrett
*Attorney, Agent, or Firm*—Sughrue, Mion, Zinn, Macpeak & Seas, PLLC

[57] ABSTRACT

The front end (7*b*) of the plug (7) of a cylinder lock is covered by a profiled element (5) which includes a key hole (6) whose profiled shape will only permit certain individual keys of a family of keys that can be inserted into the plug also to fit the profiled element. The profiled element includes attachment elements (5*b*) that have U-shaped engagement surfaces (7*b*') which co-act with corresponding engagement surfaces (7*c*) on a front part (7*b*) of the plug. The profiled element can be fitted to the lock in place, by turning the profiled element perpendicular to the plug axis. The profiled-element attachment elements (5*b*, 5*b*'; 7*c*, 7*c*') are inaccessible from outside the lock when the cylinder lock is fitted in place.

8 Claims, 3 Drawing Sheets

CYLINDER LOCK

FIELD OF INVENTION

The present invention relates to a cylinder lock of the kind defined in the preamble of claim 1.

Cylinder locks of the kind that include a profiled element fitted to the front end of the lock plug have the advantage of enabling the major part of the key slot formed in the plug to be configured to fit a large number of keys belonging to one and the same key-family, while separation between various individuals in the family is achieved by configuring the key slot of the profiled element to the appearance specific to the individual concerned, i.e. only an intended key can be inserted.

The profiled element can also be made of any chosen material, which may be different from the brass material from which the main part of the lock plug is normally made. For instance, the profiled element may be made of stainless steel or hardened steel.

The use of hardened steel also incorporates in the lock construction separate protection against an attempt to drill into the lock, which obviates the need to provide a separate drill-guard in front of the plug, for instance in the form of a separate element in the lock construction.

Another advantage afforded by a profiled element of this kind is that it can be replaced. Thus, when the key-slot opening becomes worn as a result of very frequent use of the key, it is not necessary to replace the whole of the cylinder plug or the lock cylinder, since it will normally be sufficient to replace solely the profiled element.

This replaceability of the profiled element can also be of value in cases where it is desired to prevent an unauthorized person using a key to which he/she has access or possesses, for instance after having stolen the key, gaining entry to a locked room. This can be achieved simply by replacing the profiled element, without needing to replace the entire lock cylinder.

SUMMARY OF THE INVENTION

As before mentioned, cylinder locks that include different types of profiled element are known to the art.

For instance, SE,B,8403605-2 (Wärtsilä) teaches a lock system that includes a plurality of different groups of cylinder locks that incorporate rotatable latch discs and a plurality of different types of key for the various lock groups with mutually deviating key profiles, wherewith the utility of one key profile in one lock group is determined by the latch discs of the lock and by the configuration of the key-receiving opening in the latch discs. One and the same key will have at least two different profiles disposed axially one after the other. This lock system can thus be said to include a plurality of profiled elements of the kind to which this document pertains, arranged one after the other in the lock plug. These profiled elements are not therefore intended to safeguard the plug from an attempt to force the lock from outside, for instance by drilling into the plug. Neither can the profiled element be replaced as readily as that described in the aforegoing, when the need arises.

U.S. Pat. No. 3 736 780 (Singer) describes a cylinder lock in which the profiled element is attached to the lock plug by means of externally accessible screws. A separate cover plate may optionally be crimped onto the profiled element, to enhance the aesthetic appearance of the lock. This arrangement, however, provides no real protection against forcing of the lock from the outside. The actual cover plate and the screws can be easily removed with the aid of a screwdriver for instance.

U.S. Pat. No. 4 478 061 (Preddey) teaches a cylinder lock according to the preamble of claim 1. This lock includes a releasable profiled element that has a key-slot configured for a key having two parallel coded blades for actuation of double rows of pin tumblers. The profiled element is anchored to the plug by means of a cross pin.

U.S. Pat. No. 1 422 594 (Maxwell) describes a cylinder lock in which a profiled element forms an integral part of the lock plug, said profiled element merely having a protective function and not intended to separate keys that belong to one and the same family. The profiled element extends axially beyond the nearest adjacent pin and forms a substantial part of the circumferential surface of the plug along substantially the full axial length of the element. The profiled element is secured to the plug by means of a dovetail joint whose length corresponds to the diameter of the plug.

OBJECTS OF THE INVENTION

One object of the invention is to provide a cylinder lock of the aforesaid kind which includes a profiled element and with which forcing of the plug with the aid of a screwdriver or chisel is much more difficult to achieve than in earlier cases, and with which the profiled element is securely secured and can be easily replaced when desired or when necessary, without requiring any complicated procedures to this end.

Another object of the invention is to provide a cylinder lock that includes a profiled element of the aforesaid kind and with which the lock cylinder contributes towards protecting the profiled-element attachment elements so as to render said elements inaccessible from the outside but to be easily manipulated when desired, for instance in order to remove or replace the profiled element.

DISCLOSURE OF THE INVENTION

These objects and other objects are fulfilled by an inventive cylinder lock having the features set forth in the characterizing clause of claim 1.

The mutually co-acting engagement surfaces on the profiled element and on the lock plug respectively may have a relatively large extension, therewith securing the profiled element to the plug very effectively. These anchoring elements are also inaccessible from the outside. Because the profiled element and the anchoring elements can be relatively thick and robust and parts thereof made of a hard material, for instance hardened steel or stainless steel, it will be understood that attacks made on the lock with a screwdriver or chisel or with different types of drilling tools can hardly be successful.

The invention also enables the profiled element to be fitted or mounted in a simple manner, by moving the element perpendicular to the plug axis after having removed the plug at least partially from the bore in the lock cylinder. When the plug is then inserted fully into the bore, the lock cylinder, in which the bore is formed, contributes towards protecting the engagement surfaces of the attachment elements from any form of external force.

In one preferred embodiment, the length of the mutually co-acting engagement surfaces parallel with the direction of the key slot is greater than the plug radius and is smaller than the plug diameter. In practice, the length of said surfaces may correspond to 1.6–1.8 times said radius, meaning that the profiled element will be held securely in place in its use position.

The profiled element and the plug will conveniently have mutually co-acting engagement surfaces on each side of the key opening in said profiled element and the key-slot in the plug. In practice, it is preferred that the profiled-element attachment elements that include the engagement surface or surfaces will have a generally U-shape, where the engagement surface extends continuously on one side of the key opening and around said one end thereof.

The engagement surface on the plug will conveniently have a corresponding U-shape on the side of the key-slot in the plug and around one end thereof.

In the case of one embodiment, that part of the plug which includes said engagement surface or surfaces is located in the front end of a plug-part that has a larger diameter than the main part of the plug. This embodiment also contributes to increasing the size of the mutually co-acting engagement surfaces, particularly when the diameter of the profiled element corresponds to the diameter of the enlarged part of the plug.

The plug part of larger diameter is suitably accommodated in an enlarged front part of the plug-receiving bore in the lock cylinder, wherewith the axial length of said enlarged borepart corresponds to the combined thickness of the profiled element and the enlarged plug-part. The front surface of the profiled element will not project outside the lock cylinder, but will lie in plane therewith, therewith making any attack on the lock with the use of different types of tool even more difficult to achieve.

Alternatively, the plug may lack said enlarged end-part and the key hole in the profiled element be delimited by material therearound.

Further characteristic features of a cylinder lock provided with a profiled element of the aforesaid kind and advantages afforded by such a lock will be evident from the following description of preferred embodiments thereof. The description is given with reference to the accompanying drawings.

DESCRIPTION OF PREFERRED EMBODIMENTS

Figure 1:
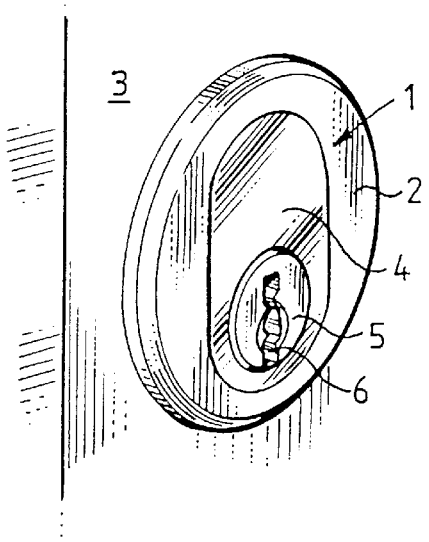
FIG. 1 is a perspective view of an inventive cylinder lock provided with a profiled element and fitted to a door together with a surrounding lock fitting.

FIG. 1 illustrates a cylinder lock 1 and a surrounding fitting 2 mounted in place in a door 3.

Figure 2:
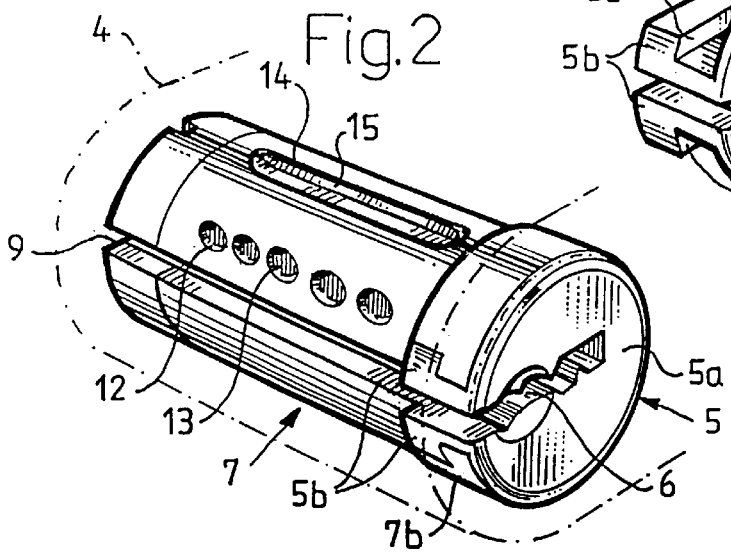
FIG. 2 is a perspective view of the plug of a cylinder lock shown in FIG. 1, with the profiled element fitted to the plug.

The lock cylinder 4 of the cylinder lock 1 has a bore which receives a plug 7 of the kind shown in FIG. 2, said plug 7 being rotatable in the lock-cylinder bore by means of a key (not shown).

The front part 7*b* of the plug 7 has a larger diameter than the main part 7*a* of the plug and is received in an enlarged front part of the bore in the lock cylinder 4.

The enlarged front part 7*b* of the plug includes a key-slot or key-hole 8 which merges with a slot 9 in the main plug-part 7*a*. In the illustrated embodiment, the key slot 8 has a comparatively regular profile, whereas the slot 9 may have an irregular shape so that only a given number of keys belonging to the same key-family can be inserted into the plug for actuation of the pin tumblers 13 accommodated in the pin channel 12 therein.

Figure 3:
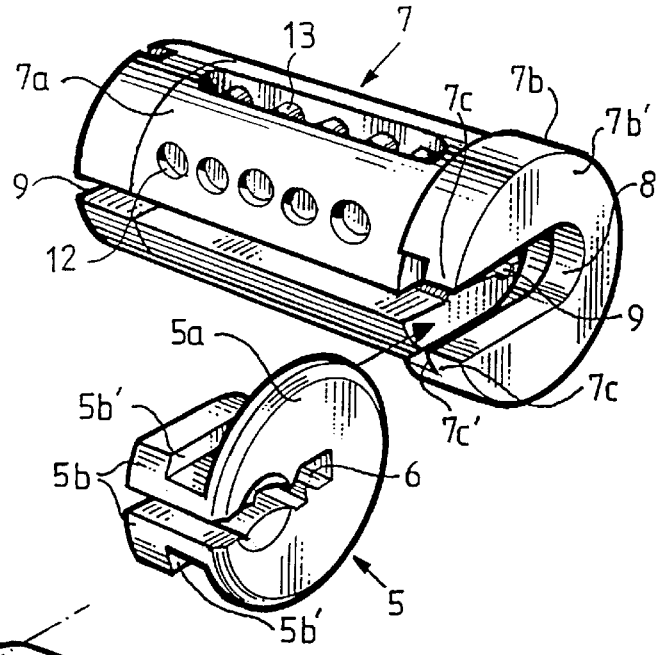
FIG. 3 is an exploded view showing the plug and profiled element of FIG. 2 dismantled, wherewith the plug is shown without its associated elements, such as pin tumblers disposed in the pin holes and the latching rod or bar co-acting therewith.

Only one row of pin channels 12 is shown in the drawing. Each of these pin channels 12 accommodates a pin tumbler 13 adapted for co-action with a latch rod or latch bar 15 accommodated in a recess 14 in the plug 7. However, the plug may include in addition to these pin channels or instead of said pin channels a central row of pin channels (not visible in FIGS. 2 and 3) that accommodate bottom pins which co-act typically with top pins (not shown) in the lock cylinder 4, optionally via intermediate pins (not shown either).

Attached in front of the enlarged front-plug part 7*b* is a profiled element 5 which is made of a hard material, e.g. stainless steel, and which has a front surface 5*a*. The profiled element 5 includes a key hole 6 whose profiled shape differs somewhat from the profiled shape of the key-slot 9 provided in the main plug-part 7*a*, such that only one or a few individuals of the key-family that can be inserted into the plug 7 will also fit the key hole 6 of the profiled element 5.

Figure 5:
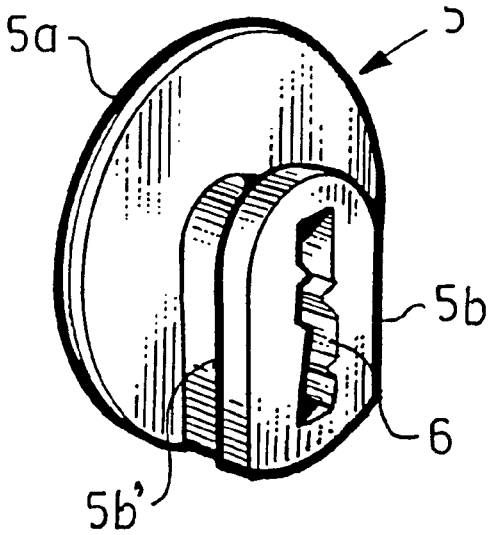

In order to enable the profiled element 5 to be fitted securely in the main plug-part 7*a* so as to deny access to the profiled element from outside, the profiled element is provided with attachment elements 5*b* which, in the illustrated embodiment—cf FIG. 5 for instance—have a general U-shape with one leg of the U on each side of the key hole 6, said legs being interconnected by an intermediate part which is taken around one end of the key hole 6.

The engagement surfaces 5*b*' of these attachment or anchoring elements 5*b* thus extend beyond one end of the key hole 6 and the key slot 8, 9, respectively, without reaching to the peripheral surface of the plug located radially outside the end of the key slot.

The attachment member or anchoring elements 5*b* co-act with corresponding attachment elements 7*c* in the enlarged part 7*b* of the plug 7, more specifically so that the engagement surfaces 5*b* on the profiled-element attachment elements 5*b* co-act with corresponding engagement surfaces 7*c*' on the attachment elements 7*c* in the enlarged plug-part 7*b*.

It will be seen that the length of the engagement surfaces 5*b*', 7*c*' parallel with the direction of the key slot 6 is greater than the radius of the plug 7, but smaller than its diameter.

Because the mutually co-acting engagement surfaces 5*b*' and 7*c*' have a comparatively long extension, e.g. about 1.7 times the radius, the profiled element 5 will be held securely and reliably on the plug 7, more specifically so that both the profiled element 5 and the plug will be inaccessible to an external attack, e.g. with a screwdriver, chisel or drill.

The lock cylinder 4 therewith contributes towards secure anchorage of the profiled element 5, since the lock cylinder ensures that no part of the anchoring elements 5*b*, 7*c* and their associated engagement surfaces 5*b*', 7*c*' are accessible from outside the lock.

On the other hand, the profiled element can be removed from the plug very easily. All that is necessary in this respect is to partially withdraw the plug from the bore in the lock cylinder 4, so as to enable the profiled element to be removed in a direction perpendicular to the direction of the plug axis (cf. FIG. 3), when exchanging the profiled element for another profiled element for instance.

The profiled element is fitted in a corresponding manner, in the opposite direction, i.e. in a direction perpendicular to the plug axis.

Figure 6:
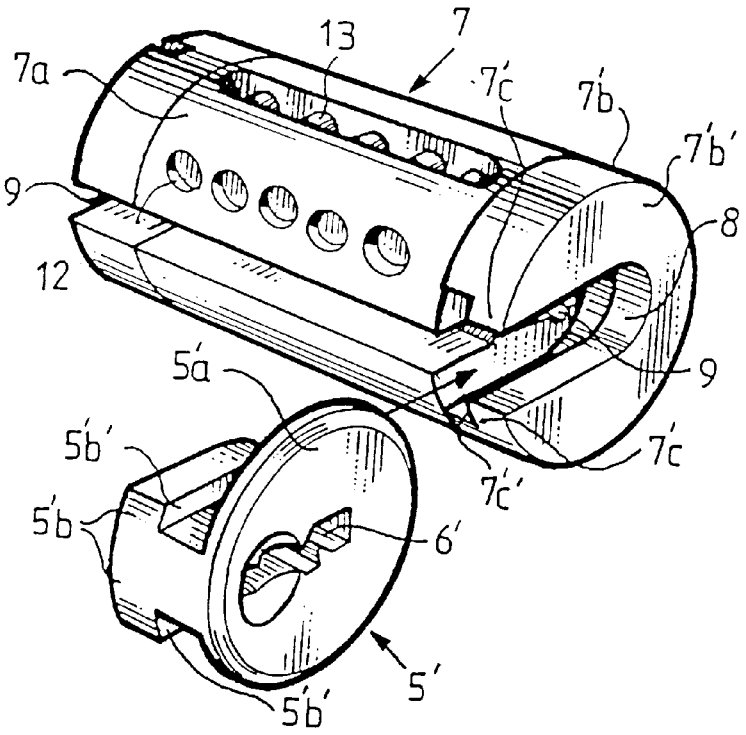
FIG. 6 is a perspective view of a modified version of the FIG. 3 embodiment.
Figure 7:
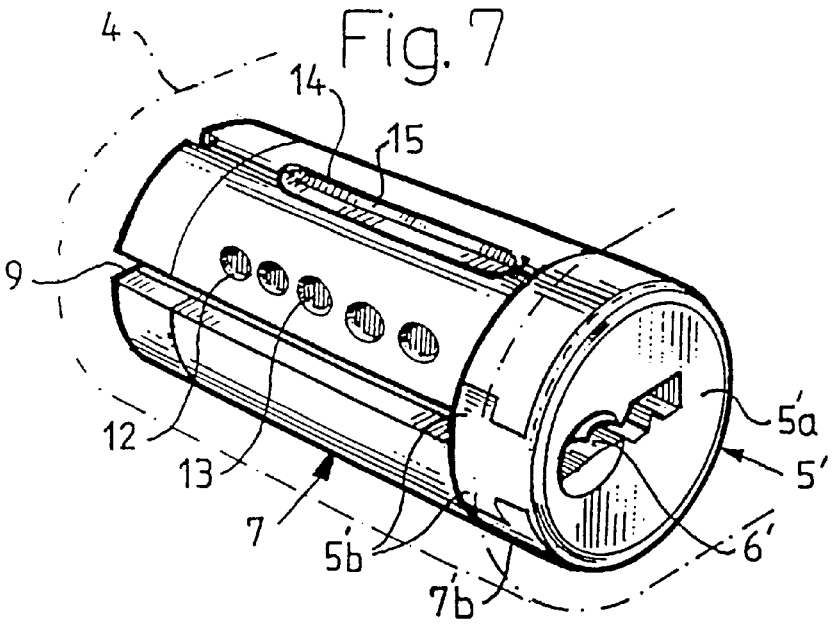
FIG. 7 is a perspective view corresponding to FIG. 2 and illustrates the modified embodiment.

The embodiment shown in FIGS. 6 and 7 differs from the embodiments shown in FIGS. 1–5 in two significant respects.

Firstly, the front plug-part 7'*b* with the front surface 7'*b* has the same diameter as the remainder of the plug; in other words the part of the plug provided with the engagement surfaces 7'*c* is not enlarged in relation to the main part of the plug.

Secondly, the key hole 6' in the profiled element 5' is completely surrounded by material, i.e. even in the region of the engagement surfaces 5'*b*' on the profiled element. The profiled element 5' thus has greater resistance to an attack from outside the lock.

Figure 4:
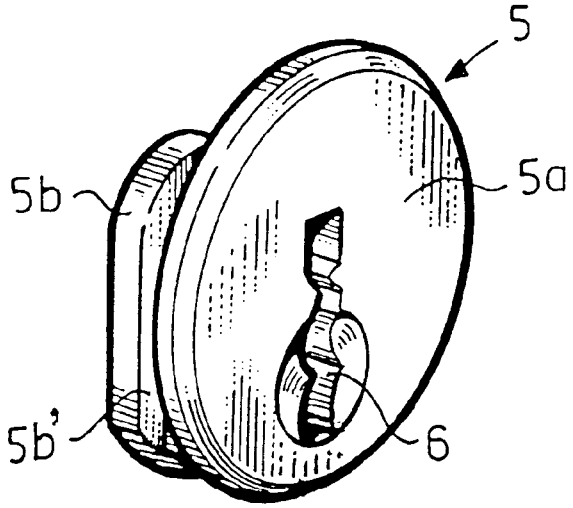
FIGS. 4 and 5 are respective front and rear views of the profiled element that can be fitted to a plug according to FIG. 3.

It will be understood that these characteristic features of the embodiment illustrated in FIGS. 6 and 7 need not both be present at the same time, i.e. a profiled element 5' whose key hole 6' is totally delimited by material may be accommodated in a front, enlarged plug-part or, alternatively, a slot-like key hole in the profiled element, e.g. according to FIGS. 4 and 5, may be accommodated in a plug that lacks an enlarged front part.

The attachment or anchoring elements 5*b*, 5*b*' of the profiled element may be designed in a manner different to that illustrated in the associated figures, provided that reliable and secure anchoring of the profiled element to the plug can be achieved and provided that the design of said elements falls within the scope of the following claims.

What is claimed is:

1. A cylinder lock comprising:

a) a lock cylinder (4) having a bore for b) rotatably accommodating a plug (7), said plug including a peripheral surface and a front end portion which defines an outer end surface (7*b*');

c) a key slot (8, 9) in the plug for insertion of a key blade having a profile adapted to a profile of the key slot;

d) at least one row of pin channels (12) in the plug for accommodating pin tumblers (13) co-acting with the key blade;

e) a profiled element (5; 5') mounted at the font end portion of the plug (7) and provided with a key hole (6; 6') having a profile which deviates partially from the profile of the plug key-slot, so that only certain keys that are insertable into the plug key-slot can be inserted into the key hole (6) of the profiled element (5); and f) attachment members (5*b*; 7*c*) for releasably attaching the profiled element to the plug (7), said attachment members being inaccessible from outside the lock when the plug is inserted to a use position in said bore, said attachment members having an engagement surface (5*b*') which extends perpendicular to a plug axis and which is located closer to the front end portion of the plug than the first pin channel (12) in said row, and which engagement surface (5*b*') is operative for co-action with a corresponding engagement surface (7*c*') on said plug such as to anchor the profiled element (5) reliably to the plug (7) when the profiled element (5) is in an applied position;

g) said engagement surfaces (5*b*'; 7*c*') of said attachment members extending beyond at least one end of the key hole (6) and the key slot (8, 9), respectively, without reaching the peripheral surface of the plug located radially outside said end of said key slot, and enabling the profiled element (5) to be fitted perpendicularly to the plug axis when the plug is at least partially removed from the bore in the lock cylinder (4), wherein an outer surface (5*a*) of the profiled element (5), which is formed of a hard material relative to a material from which the plug is formed, in the applied position of the profiled element, completely covers the outer end surface (7*b*') of the plug, and wherein said cooperating engagement surfaces (5*b*'; 7*c*') of said attachment members are spaced apart from a rear side of the profiled element so as to be situated at an axial distance from the rear side of the profiled element, the rear side lying close to the outer end surface (7*b*') of the plug.

2. The cylinder lock according to claim 1, wherein the engagement surfaces (5*b*'; 7*c*') have a length, parallel with a direction of the key slot (6), which is greater than a radius of the plug and smaller than a diameter of the plug.

3. The cylinder lock according to claim 1, in which the profiled element (5) and the plug (7) include mutually co-acting engagement surfaces (5*b*'; 7*c*') on each side of the key hole (6) in the profiled element (5) and the key slot (9) in the plug (7) respectively, wherein the attachment element (5*b*) on the engagement surface or surfaces (5*b*') of the profiled element has a generally U-shape, where the engagement surface (5*b*') extends continuously on one side of the key hole (6) and around said at least one end of the key hole (6).

4. The cylinder lock according to claim 3, wherein the engagement surface (7*c*') on the plug (7) has a corresponding U-shape on one side of the plug key-slot (8, 9) and around said at least one end of the key-slot.

5. The cylinder lock according to claim 1, wherein the key hole (6') in the profiled element is completely delimited by material including in a region of said engagement surface (5'*b*').

6. The cylinder lock according to claim 1, wherein said engagement surface or surfaces (7*c*') is located in an enlarged plug-part (7*b*) that has a larger diameter than a main part (7*a*) of the plus.

7. The cylinder lock according to claim 6, wherein the profiled element (5) has a diameter which corresponds to the diameter of said enlarged plug-part (7*b*).

8. The cylinder lock according to claim 7, wherein the plug-part (7*b*) of larger diameter is accommodated in an enlarged front part of the bore in the lock cylinder (4) in which the plug (7) is accommodated, and wherein an axial length of said enlarged front part of the bore corresponds to the combined thickness of the profiled element (5) and the enlarged plug-part (7*b*).

* * * * *